US009958194B2

(12) United States Patent
Tashiro et al.

(10) Patent No.: US 9,958,194 B2
(45) Date of Patent: May 1, 2018

(54) REFRIGERATION CYCLE APPARATUS WITH A HEATING UNIT FOR MELTING FROST OCCURRING IN A HEAT EXCHANGER

(75) Inventors: Yusuke Tashiro, Tokyo (JP); Kosuke Tanaka, Tokyo (JP); Sangmu Lee, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 816 days.

(21) Appl. No.: 14/241,590

(22) PCT Filed: Jan. 25, 2012

(86) PCT No.: PCT/JP2012/000449

§ 371 (c)(1),
(2), (4) Date: Feb. 27, 2014

(87) PCT Pub. No.: WO2013/051166

PCT Pub. Date: Apr. 11, 2013

(65) Prior Publication Data

US 2014/0216092 A1 Aug. 7, 2014

(30) Foreign Application Priority Data

Oct. 3, 2011 (JP) ..... 2011-219626

(51) Int. Cl.
*F25B 47/00* (2006.01)
*F25B 41/00* (2006.01)
(Continued)

(52) U.S. Cl.
CPC ..... *F25D 21/06* (2013.01); *F25B 47/02* (2013.01); *F25D 21/14* (2013.01); *F28D 1/0435* (2013.01);
(Continued)

(58) Field of Classification Search
CPC ..... F25D 21/06; F25D 1/0435; F25D 1/0452; F25D 21/12; F25D 21/08; F25B 47/006;
(Continued)

(56) References Cited

U.S. PATENT DOCUMENTS 3,451,226 A * 6/1969 Shriver ..... F25D 21/14 62/275
5,083,373 A * 1/1992 Hamburgen ..... H01L 23/433 257/714
(Continued)

FOREIGN PATENT DOCUMENTS

JP 60-60466 A 4/1985
JP 60-75860 U 5/1985
(Continued)

OTHER PUBLICATIONS

Okaza, Jan. 2011, English Translation, European Patent Office.*
(Continued)

*Primary Examiner* — Keith Raymond
*Assistant Examiner* — Steve Tanenbaum
(74) *Attorney, Agent, or Firm* — Posz Law Group, PLC

(57) ABSTRACT

A refrigeration cycle apparatus includes a compressor, a condenser such as an indoor heat exchanger, first expansion means, and an evaporator such as an outdoor heat exchanger that are connected by refrigerant pipes to form a refrigeration cycle. The evaporator is a heat exchanger including a plurality of plate-like heat transfer fins arranged in parallel and subjected to water slip or water repellent treatment, and a heat transfer tube provided in contact with the plurality of heat transfer fins such that refrigerant flows therein. The refrigeration cycle apparatus further includes a drain pan disposed below the evaporator, an evaporator fan for producing an air current flowing to the evaporator, such as an outdoor fan, and a heating unit disposed at a position below
(Continued)

the heat transfer fins and on a leeward side of the heat transfer fins.

9 Claims, 14 Drawing Sheets

(51) Int. Cl.

| | |
|---|---|
| ***F28D 17/00*** | (2006.01) |
| ***F25D 21/06*** | (2006.01) |
| ***F25B 47/02*** | (2006.01) |
| ***F28F 17/00*** | (2006.01) |
| ***F28F 1/32*** | (2006.01) |
| ***F25D 21/14*** | (2006.01) |
| ***F28D 1/04*** | (2006.01) |
| ***F28D 1/053*** | (2006.01) |
| *F28D 21/00* | (2006.01) |
| *F24F 11/00* | (2018.01) |
| *F25B 39/02* | (2006.01) |
| *F25B 13/00* | (2006.01) |
| *F25B 41/04* | (2006.01) |

(52) U.S. Cl.
CPC ..... *F28D 1/053* (2013.01); *F28F 1/32* (2013.01); *F28F 17/00* (2013.01); *F28F 17/005* (2013.01); *F24F 2011/0089* (2013.01); *F25B 13/00* (2013.01); *F25B 39/022* (2013.01); *F25B 41/04* (2013.01); *F25B 2341/0662* (2013.01); *F25B 2400/12* (2013.01); *F28D 2021/0068* (2013.01); *F28D 2021/0071* (2013.01); *F28F 2215/02* (2013.01); *F28F 2215/12* (2013.01); *F28F 2245/04* (2013.01)

(58) Field of Classification Search
CPC ..... F25B 2313/0211; F25B 47/022; F25B 47/02; F28F 2215/02; F28F 19/006; F28D 1/0408; F28D 1/0417; F28D 1/0426; F28D 1/0435
USPC ..... 62/277, 81, 278; 165/10
See application file for complete search history.

(56) References Cited

U.S. PATENT DOCUMENTS

| | | | | |
|---|---|---|---|---|
| 5,315,836 | A * | 5/1994 | Ressler | F25B 47/022 62/277 |
| 7,477,861 | B2 * | 1/2009 | Taira | G03G 15/2039 399/96 |
| 2006/0181848 | A1 * | 8/2006 | Kiley | H01L 23/427 361/697 |
| 2011/0154845 | A1 | 6/2011 | Ashida | |
| 2012/0181004 | A1 * | 7/2012 | Son | F28F 17/00 165/133 |

FOREIGN PATENT DOCUMENTS

| | | | | |
|---|---|---|---|---|
| JP | 60-77974 | U | | 5/1985 |
| JP | 61-96170 | | * | 6/1986 |
| JP | 61-96170 | U | | 6/1986 |
| JP | 96170 | | * | 6/1986 |
| JP | H11-63768 | A | | 3/1999 |
| JP | 2002-323298 | A | | 11/2002 |
| JP | 2005-049002 | A | | 2/2005 |
| JP | 2005049002 | A | * | 2/2005 |
| JP | 2006-046696 | A | | 2/2006 |
| JP | 2006-183897 | A | | 7/2006 |
| JP | 2010-085056 | A | | 4/2010 |
| JP | 2010-175131 | A | | 8/2010 |
| JP | 2010-175163 | A | | 8/2010 |
| JP | 2011-012844 | A | | 1/2011 |
| JP | 2011012844 | A | * | 1/2011 |

OTHER PUBLICATIONS

International Search Report of the International Searching Authority dated Mar. 13, 2012 for the corresponding international application No. PCT/JP2012/000449 (and English translation).
Extended European Search Report dated Sep. 8, 2015 in the corresponding EP application No. 12838256.1.
Chinese Office Action dated Jan. 29, 2016 in the corresponding CN application No. 201280048799.0(English translation attached).
Office Action dated Jun. 2, 2015 issued in corresponding CN patent application No. 201280048799.0 (and English translation).

* cited by examiner

REFRIGERATION CYCLE APPARATUS WITH A HEATING UNIT FOR MELTING FROST OCCURRING IN A HEAT EXCHANGER

CROSS REFERENCE TO RELATED APPLICATIONS

This application is a U.S. national stage application of International Application No. PCT/JP2012/000449 filed on Jan. 25, 2012 and is based on Japanese Patent Application No. 2011-219626 filed on Oct. 3, 2011, the disclosure of which is incorporated by reference.

TECHNICAL FIELD

The present invention relates to a refrigeration cycle apparatus including a heating unit that melts frost occurring in a heat exchanger using fins subjected to water repellent or water slip treatment.

BACKGROUND ART

In an air-conditioning apparatus serving as a refrigeration cycle apparatus, a heating operation is performed by operating, as an evaporator, an outdoor heat exchanger provided in an outdoor unit so as to remove heat from outdoor air (external air) and to draw the heat into an indoor unit.

For this reason, for example, when the outdoor air temperature is low (for example, the dry-bulb temperature is 2 degrees C. and the wet-bulb temperature is 1 degree C. under the JIS low heating temperature condition), the surface temperature of the outdoor heat exchanger becomes 0 degrees C. or less, and this causes a frosting phenomenon in which moisture in the air flowing into the outdoor heat exchanger adheres as frost to the surface of the outdoor heat exchanger (hereinafter, a condition of the outdoor air temperature under which this frosting phenomenon occurs is referred to as "a low outdoor-air temperature condition").

If this frosting phenomenon occurs in the outdoor heat exchanger, a part of the outdoor heat exchanger is covered with frost, and this increases the ventilation resistance caused in the air when the air passes through the outdoor heat exchanger. The amount of air flowing into the outdoor heat exchanger is thereby decreased, and as a result, the heating capacity of the air-conditioning apparatus sometimes decreases. Accordingly, in the air-conditioning apparatus, for example, a defrosting operation for removing frost adhering to the outdoor heat exchanger is performed by heating the outdoor heat exchanger with separate heating means. However, the heating operation needs to be stopped during defrosting operation for melting the frost. Thus, when the defrosting operation is performed, comfort in the room serving as an air-conditioned space is deteriorated.

To solve this problem, there has been proposed a method for suppressing frosting caused in an outdoor heat exchanger under a low outdoor-air temperature condition by forming, on a surface of the outdoor heat exchanger, a frosting suppressing layer that enhances water slip performance and water repellency and suppresses frosting (see, for example, Patent Literature 1).

CITATION LIST

Patent Literature

Patent Literature 1: Japanese Unexamined Patent Application Publication No. 2002-323298 (page 4, FIG. 2)

SUMMARY OF INVENTION

Technical Problem

However, even when the above frosting suppressing technique described in Patent Literature 1 is used, a frosting phenomenon occurs in the outdoor heat exchanger according to conditions. Hence, there is no other choice but to defrost the outdoor heat exchanger.

The present invention has been made to solve the above problems, and an object of the invention is to obtain a refrigeration cycle apparatus that can effectively perform defrosting in an evaporator using a heat exchanger subjected to water repellent or water slip treatment.

Solution to Problem

A refrigeration cycle apparatus according to the present invention includes a compressor, a condenser, first expansion means, and an evaporator that are connected by refrigerant pipes to form a refrigeration cycle. The evaporator is a heat exchanger including a plurality of plate-like heat transfer fins arranged in parallel and subjected to water slip or water repellent treatment, and a heat transfer tube provided in contact with the plurality of heat transfer fins such that refrigerant flows therein. The refrigeration cycle apparatus further includes a drain pan disposed below the evaporator, an evaporator fan for producing an air current flowing to the evaporator, and a heating unit disposed at a position below the heat transfer fins and on a leeward side of the heat transfer fins.

Advantageous Effects of Invention

According to the present invention, frost occurring in the evaporator using the heat transfer fins subjected to water slip or water repellent treatment can be removed effectively. This can restrict the capacity from being reduced by an increase in ventilation resistance due to a frosting phenomenon in the evaporator.

DESCRIPTION OF EMBODIMENTS

Embodiment 1

[Configuration of Air-Conditioning Apparatus]

Figure 1:
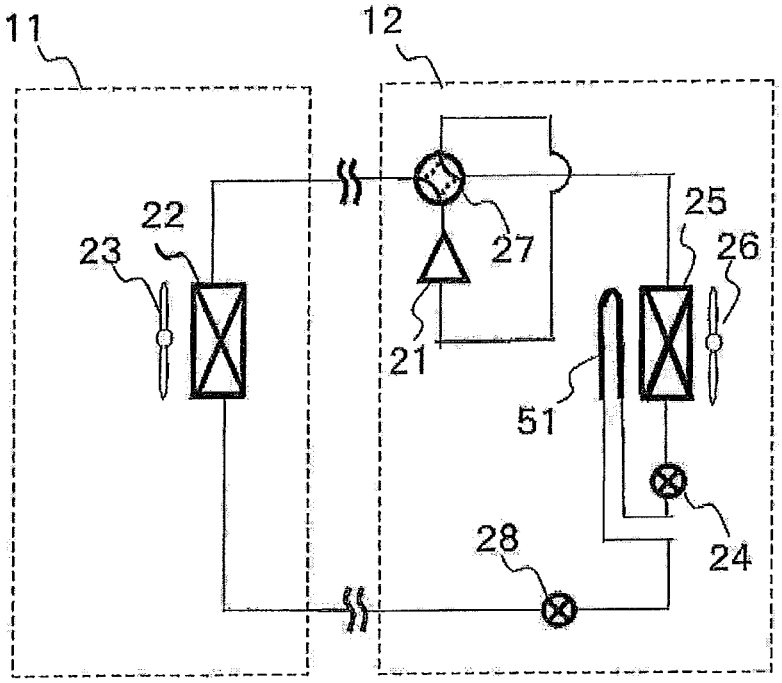
FIG. 1 illustrates a configuration of a refrigerant circuit in an air-conditioning apparatus according to Embodiment 1 of the present invention.

FIG. 1 illustrates a configuration of a refrigerant circuit in an air-conditioning apparatus according to Embodiment 1 of the present invention. While the present invention relates to refrigeration cycle apparatuses, an air-conditioning apparatus will be given as one example of the refrigeration cycle apparatuses in the description of Embodiment 1.

As illustrated in FIG. 1 the air-conditioning apparatus of Embodiment 1 is composed of an indoor unit 11 and an outdoor unit 12.

The indoor unit 11 includes an indoor heat exchanger 22 and an indoor fan 23. The outdoor unit 12 includes a compressor 21, first expansion means 24, outdoor heat exchanger 25, an outdoor fan 26, a four-way valve 27, second expansion means 28, and a heating unit 51.

Among these elements, the compressor 21, the four-way valve 27, the indoor heat exchanger 22, the second expansion means 28, the heating unit 51, the first expansion means 24, the outdoor heat exchanger 25, the four-way valve 27, and the compressor 21 are connected in this order by refrigerant pipes to configure a refrigeration cycle. For example, refrigerant, such as R410A, circulates in the refrigeration cycle. The indoor unit 11 and the outdoor unit 12 are physically connected by a refrigerant pipe that connects the four-way valve 27 and the indoor heat exchanger 22 and a refrigerant pipe that connects the indoor heat exchanger 22 and the second expansion means 28.

The compressor 21 sucks and compresses gas refrigerant into a high-temperature and high-pressure state, and then discharges the gas refrigerant.

When the air-conditioning apparatus of Embodiment 1 performs a heating operation, the indoor heat exchanger 22 functions as a radiator. At this time, when part of indoor air is passed through the indoor heat exchanger 22 by the indoor fan 23, heat exchange is conducted in the indoor heat exchanger 22, and the refrigerant heats the indoor air to heat an air-conditioned space. Further, the outdoor heat exchanger 25 functions as an evaporator. When part of outdoor air is passed through the outdoor heat exchanger 25 by the outdoor fan 26, heat exchange is conducted in the outdoor heat exchanger 25, and the outdoor air heats the refrigerant.

In contrast, when the air-conditioning apparatus performs a cooling operation, the indoor heat exchanger 22 functions as an evaporator. At this time, when part of indoor air is passed through the indoor heat exchanger 22 by the indoor fan 23, heat exchange is conducted in the indoor heat exchanger 22, and the refrigerant cools the indoor air to cool the air-conditioned space. Further, the outdoor heat exchanger 25 functions as a radiator. When part of outdoor air is passed through the outdoor heat exchanger 25 by the outdoor fan 26, heat exchange is conducted in the outdoor heat exchanger 25, and the outdoor air cools the refrigerant.

The first expansion means 24 and the second expansion means 28 expand or decompress the refrigerant.

While one indoor unit 11 is connected to the outdoor unit 12 and the second expansion means 28 is provided in the outdoor unit 12, as illustrated in FIG. 1, the structure is not limited thereto. That is, a plurality of indoor units 11 may be connected to the outdoor unit 12 and may be connected in parallel to one another. In this case, the second expansion means 28 may be provided not in the outdoor unit 12, but in each of the indoor units 11.

The four-way valve 27 switches a passage of refrigerant discharged from the compressor 21. Specifically, when the air-conditioning apparatus of Embodiment 1 is performing a heating operation, the four-way valve 27 switches the refrigerant passage so that the refrigerant discharged from the compressor 21 flows toward the indoor heat exchanger 22. In contrast, when the air-conditioning apparatus is performing a cooling operation, the four-way valve 27 switches the refrigerant passage so that the refrigerant discharged from the compressor 21 flows toward the outdoor heat exchanger 25.

The heating unit 51 melts frost occurring in the outdoor heat exchanger 25, and a melting operation thereof will be described below.

The indoor heat exchanger 22, the outdoor heat exchanger 25, and the outdoor fan 26 correspond to "a compressor," "an evaporator," and "an evaporator fan" in the present invention, respectively.

[Structure of Outdoor Heat Exchanger 25]

Figure 2:
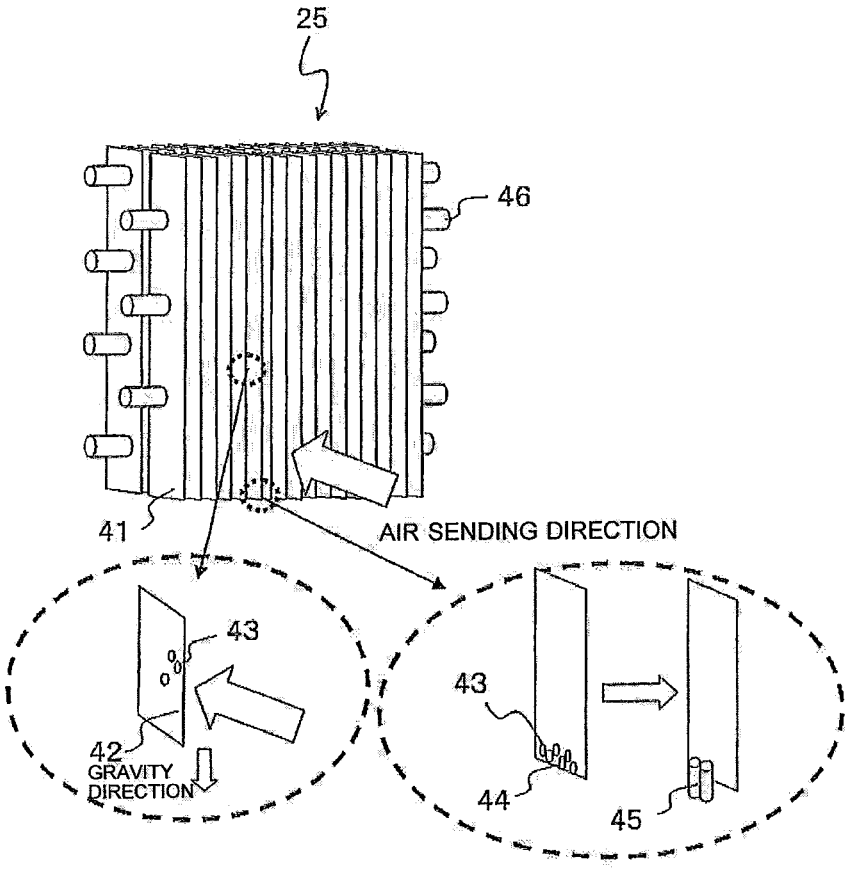
FIG. 2 illustrates a structure and a frosting state of an outdoor heat exchanger 25 in the air-conditioning apparatus according to Embodiment 1 of the present invention.

FIG. 2 illustrates a structure and a frosting state of the outdoor heat exchanger 25 in the air-conditioning apparatus according to Embodiment 1 of the present invention.

As illustrated in FIG. 2, the outdoor heat exchanger 25 in the air-conditioning apparatus of Embodiment 1 is a fin-tube type heat exchanger composed of heat transfer fins 41 and heat transfer tubes 46.

As illustrated in FIG. 2, each of the heat transfer fins 41 is shaped like a vertically long plate and is formed of a material such as aluminum, and its surface is subjected to water slip treatment or water repellent treatment. A plurality of heat transfer fins 41 are arranged in a width direction against an air current, and plate surfaces thereof are arranged in line and parallel to one another. A plurality of heat transfer tubes 46 penetrate each of the heat transfer fins 41 perpendicularly to the plate surfaces. The plural heat transfer tubes 46 are tubes through which the refrigerant flows. Although not illustrated, for example, end portions of these heat transfer tubes 46 are connected in series, and the refrigerant flows in the heat transfer tubes 46 connected in series so that heat is exchanged between the air and the refrigerant via the heat transfer fins 41. A unit in which the heat transfer fins 41 are arranged in line such that the plate surfaces are parallel to one another, the plural heat transfer tubes 46 penetrate the heat transfer fins 41 perpendicularly to the plate surfaces, and the heat transfer tubes are connected in the above manner, as described above, is referred to as "a heat exchange unit." The outdoor heat exchanger 25 of Embodiment 1 is composed of two heat exchange units stacked against the air current.

While the heat transfer tubes 46 perpendicularly penetrate the heat transfer fins 41, as illustrated in FIG. 2, the structure is not particularly limited to such a structure in which the heat transfer tubes 46 perpendicularly penetrate the heat transfer fins 41.

While the outdoor heat exchanger 25 is formed by arranging two heat exchange units, the structure is not limited thereto. Only one, or three or more heat exchange units may be arranged.

[Frosting Phenomenon of Outdoor Heat Exchanger 25]

Next, a description will be given of a frosting phenomenon caused in the outdoor heat exchanger 25 during heating operation, with reference to FIG. 2.

During heating operation, outdoor air sent from the outdoor fan 26 (not illustrated in FIG. 2) impinges on windward portions 42 serving windward side portions of the heat transfer fins 41 in the outdoor heat exchanger 25. At this time, heat exchange is conducted between the outdoor air flowing in the outdoor heat exchanger 25 and the refrigerant flowing in the heat transfer tubes 46 via the heat transfer tubes 46 and the heat transfer fins 41 by a leading edge effect. Since the outdoor heat exchanger 25 operates as an evaporator, the outdoor air flowing in the outdoor heat exchanger 25 is cooled. Moisture in the outdoor air is actively condensed particularly in the windward portions 42 of the outdoor heat exchanger 25, and condensed water droplets 43 are formed on the surfaces of the heat transfer fins 41. The condensed water droplets 43 on the heat transfer fins 41 gradually increase in size while collecting other condensed water droplets 43 formed in the surroundings. When the size of the condensed water droplets 43 reaches a certain level (about several hundred micrometers), the condensed water droplets 43 fall down under their own weight while being slightly swept leeward by air sent from the outdoor fan 26 without separating from the heat transfer fins 41. The condensed water droplets 43 fallen from various positions on the surfaces of the heat transfer fins 41 gather in the lowermost fin portions 44 serving as lower end portions of the heat transfer fins 41.

Under a low outdoor-air temperature condition, the surface temperature of the heat transfer fins 41 drops below freezing point (for example, −5 degrees C.). At this time, under normal circumstances, the condensed water droplets 43 on the heat transfer fins 41 freeze because the temperature thereof becomes equal to the surface temperature of the heat transfer fins 41. In Embodiment 1, however, the condensed water droplets 43 on the heat transfer fins 41 do not freeze, but maintain a supercooled state because the contact areas with the heat transfer fins 41 are decreased by water slip or water repellant treatment provided on the surfaces of the heat transfer fins 41, or the condensed water droplets 43 are put in a stable state because of a decrease in surface energy due to water slip or water repellant treatment. However, when the condensed water droplets 43 further gather and increase in size on a leeward side of the heat transfer fins 41 and in the lowermost fin portions 44, they fall from the lowermost fin portions 44. Since the condensed water droplets 43 are brought into an unstable state at this time, they are released from the supercooled state. As a result, as illustrated in FIG. 2, the condensed water droplets 43 freeze into frost in the lowermost portions 44, so that icicles 45 are formed. Once the icicles 45 are formed in the outdoor heat exchanger 25, and then supercooled condensed water droplets 43 fallen contact the icicles 45, they are released from the supercooled state and become frost. Thus, the icicles 45 continue growing and increase in size. Even when the heat transfer fins 41 of the outdoor heat exchanger 25 are thus subjected to water slip or water repellent treatment, icicles 45 are formed on the leeward side of the heat transfer fins 41 and in the lowermost fin portions 44. Once a frosting phenomenon occurs in the outdoor heat exchanger 25, the ventilation resistance increases when air passes through the outdoor heat exchanger 25, and the amount of air flowing in the outdoor heat exchanger 25 decreases. This reduces the heating capacity of the air-conditioning apparatus. Therefore, even in the outdoor heat exchanger 25 including the heat transfer fins 41 subjected to water slip or water repellant treatment, it is necessary, for example, to melt icicles 45 so that frost formed in the outdoor heat exchanger 25 does not form icicles 45 or so that icicles 45 do not grow. For example, as long as the icicles 45 can be melted while performing the heating operation, the heating operation can be continued under a low outdoor-air temperature condition.

[Structure of Outdoor Unit 12]

Figure 3:
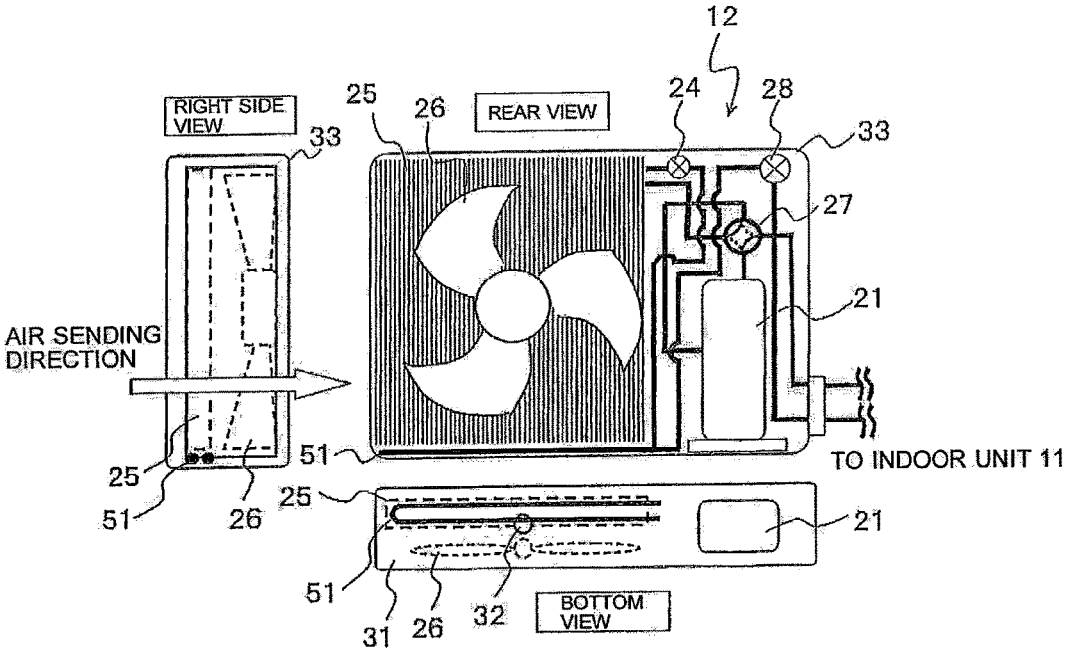
FIG. 3 schematically illustrates a structure of an outdoor unit 12 in the air-conditioning apparatus according to Embodiment 1 of the present invention.

With reference to FIG. 3, a description will be given below of a structure of the outdoor unit 12 for melting the icicles 45.

FIG. 3 schematically illustrates the structure of the outdoor unit 12 in the air-conditioning apparatus according to Embodiment 1 of the present invention. FIG. 3 illustrates a rear view, a bottom view, and a right side view of the outdoor unit 12.

As illustrated in FIG. 3, the outdoor unit 12 includes a unit case 33 serving as a housing. In the unit case 33, the compressor 21, the first expansion means 24, the outdoor heat exchanger 25, the four-way valve 27, and the second expansion means 28, which are described above with reference to FIG. 1, are arranged while being connected by refrigerant pipes. The outdoor unit 12 further includes the outdoor fan 26, a drain pan 31, and the heating unit 51.

The outdoor fan 26 is disposed on a rear side of the outdoor heat exchanger 25, and is rotationally driven to send outdoor air into the outdoor heat exchanger 25. As illustrated in FIG. 3, when the outdoor fan 26 is rotationally driven, air is sent in a direction from the outdoor heat exchanger 25 toward the outdoor fan 26.

The direction in which air is sent by rotational driving of the outdoor fan 26 is not limited to the direction from the outdoor heat exchanger 25 toward the outdoor fan 26 illustrated in FIG. 3, and may be a direction from the outdoor fan 26 toward the outdoor heat exchanger 25.

The drain pan 31 is disposed on an inner bottom surface of the unit case 33, and is disposed at a position below the outdoor heat exchanger 25. The drain pan 31 receives and temporarily retains drain water occurring when the outdoor heat exchanger 25 operates as an evaporator. Near the lowermost point of the drain pan 31, a drain hole 32 is provided to penetrate the drain pan 31 and the bottom surface of the unit case 33. Drain water retained in the drain pan 31 is drained out of the outdoor unit 12 through the drain hole 32.

While only one drain hole 32 is provided in the drain pan 31 and the bottom surface of the unit case 33, as illustrated in FIG. 3, a plurality of drain holes may be formed.

The heating unit 51 is a refrigerant pipe disposed in a space between the lowermost fin portions 44 of the outdoor heat exchanger 25 and the drain pan 31. The heating unit 51 is disposed in a U-form illustrated in FIG. 3 (hereinafter referred to as "one turn") such as to extend in a longitudinal direction directly below and on leeward sides of the two heat exchange units arranged to constitute the outdoor heat exchanger 25. By thus disposing the heating unit 51 below the heat exchange units, the presence of the heating unit 51 can be restricted interfering with air sending of the outdoor fan 26 and from increasing the ventilation resistance of the outdoor heat exchanger 25. Also, the heating unit 51 is located between the first expansion means 24 and the second expansion means 28 in the above-described refrigeration cycle. In the refrigerant pipe that forms the heating unit 51, refrigerant of an intermediate pressure between a discharge pressure (high pressure) and a suction pressure (low pressure) of the compressor 1 flows. An operation in which the refrigerant flowing in the heating unit 51 is given an intermediate pressure will be described below. Since this intermediate-pressure refrigerant is kept at 0 degrees C. or more even under a low outdoor-air temperature condition, the heating unit 51 disposed below the lowermost fin portions 44 of the heat transfer fins 41 can melt icicles 45 formed in the lowermost fin portions 44 and on the leeward side of the heat transfer fins 41.

The heating unit 51 of Embodiment 1 is disposed out of contact with the drain pan 31. This eliminates the amount of heat necessary to heat the drain pan 31 itself. Hence, for example, when heating of the heating unit 51 can be turned on and off according to the operating state, the temperature can be quickly increased from an OFF state to an ON state. Further, since the necessary amount of heat can be suppressed energy saving is achieved.

The heating unit 51 is also disposed out of contact with the outdoor heat exchanger 25. This is because, if the heating unit 51 is in contact with the outdoor heat exchanger 25, the fin temperature near the lowermost fin portions 44 of the outdoor heat exchanger 25 increases and the amount of heat to be exchanged between the outdoor heat exchanger 25 and outdoor air decreases. Therefore, the heating unit 51 is preferably disposed in the space between the lowermost fin portions 44 of the outdoor heat exchanger 25 and the drain pan 31 on the leeward side of the heat transfer fins 41 such as not to be in contact with both the drain pan 31 and the lowermost fin portions 44.

While the outdoor heat exchanger 25, the heating unit 51, and the drain pan 31 have the above-described positional relationship illustrated in FIG. 3, the positional relationship among other devices illustrated in FIG. 3 is just exemplary, and is not limited to the structure of FIG. 3.

[Heating Operation in Low Outdoor-Air Temperature Condition]

Figure 4:
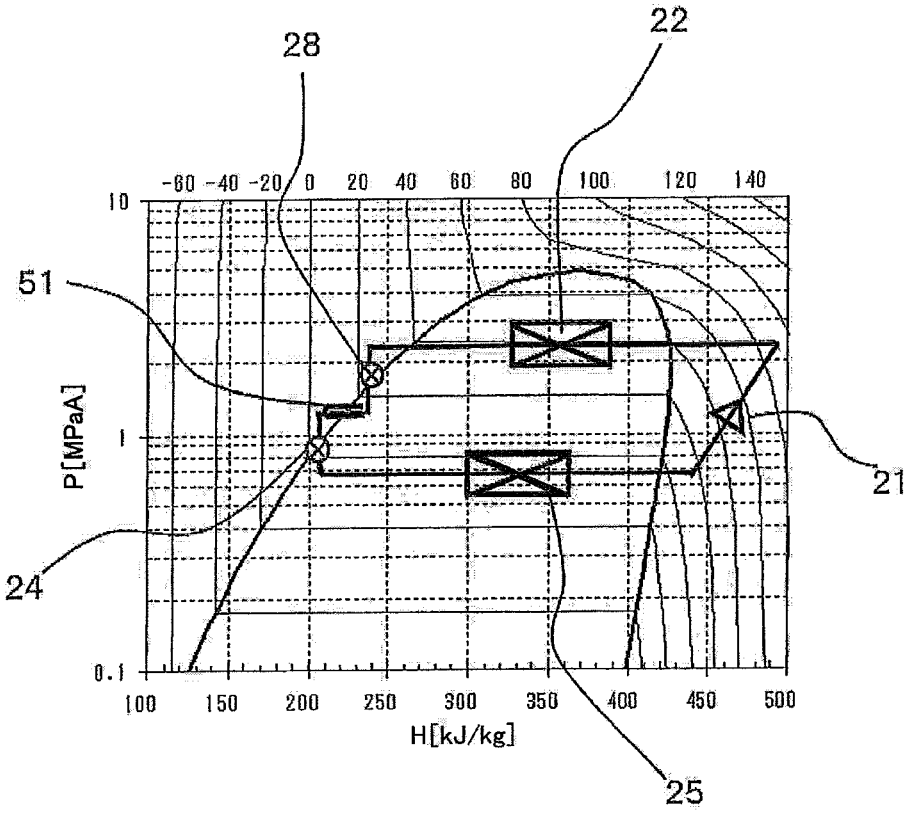
FIG. 4 is a Mollier diagram showing a heating operation under a low outdoor-air temperature condition in the air-conditioning apparatus according to Embodiment 1 of the present invention.

FIG. 4 is a Mollier diagram showing a heating operation under a low outdoor-air temperature condition in the air-conditioning apparatus according to Embodiment 1 of the present invention. The heating operation under the low outdoor-air temperature condition will be described below with reference to FIG. 4.

First, it is assumed that, in the heating operation, the four-way valve 27 switches the refrigerant passage such that the refrigerant discharged from the compressor 21 flows toward the indoor heat exchanger 22. A low-temperature and low-pressure gas refrigerant is compressed by the compressor 21, and is discharged in a high-temperature and high-pressure state. The high-temperature and high-pressure refrigerant discharged from the compressor 21 flows out of the outdoor unit 12 via the four-way valve 27. The high-temperature and high-pressure refrigerant that has flowed out of the outdoor unit 12 flows into the indoor unit 11, and further flows into the indoor heat exchanger 22 provided therein. The high-temperature and high-pressure refrigerant that has flowed in the indoor heat exchanger 22 exchanges heat with indoor air sent by the indoor fan 23, and is condensed into a high-pressure liquid refrigerant. The high-pressure liquid refrigerant that has flowed out of the indoor heat exchanger 22 flows out of the indoor unit 11. The high-pressure liquid refrigerant that has flowed out of the indoor unit 11 flows into the outdoor unit 12 again. The high-pressure liquid refrigerant that has flowed in the outdoor unit 12 is expanded by the second expansion means 28, is decompressed to an intermediate pressure, and is cooled to a temperature such that the saturation temperature becomes 0 degrees C. or more (for example, about 10 degrees C.). Then, the intermediate-pressure refrigerant flows into the heating unit 51, and transfers heat in the heating unit 51 to melt icicles 45 occurring in the lowermost fin portions 44 of the outdoor heat exchanger 25. Conversely, the intermediate-pressure refrigerant in the heating unit 51 is cooled because its heat is removed by the icicles 45. In this way, to melt the icicles 45 as frost occurring in the outdoor heat exchanger 25, the refrigerant in the heating unit 51 needs to be expanded by the second expansion means 28 to a temperature such that at least the saturation temperature becomes 0 degrees C. or more (for example, about 10 degrees C.). Further, the icicles 45 are melted by the heating unit 51, and fail as drain water into the drain pan 31. This drain water is drained from the drain hole 32.

The intermediate-pressure refrigerant that has passed through the heating unit 51 is further expanded and decompressed by the first expansion means 24, and is turned into a low-temperature and low-pressure two-phase gas-liquid refrigerant (for example, saturation temperature is −5 degrees C.). This low-temperature and low-pressure two-phase gas-liquid refrigerant flows into the outdoor heat exchanger 25. The low-temperature and low-pressure two-phase gas-liquid refrigerant that has flowed in the outdoor heat exchanger 25 exchanges heat with outdoor air sent by the outdoor fan 26, and is thereby evaporated into a low-temperature and low-pressure gas refrigerant. The low-temperature and low-pressure gas refrigerant that has flowed out of the outdoor heat exchanger 25 is sucked into the compressor 21, where it is compressed again.

[Normal Heating Operation]

Figure 5:
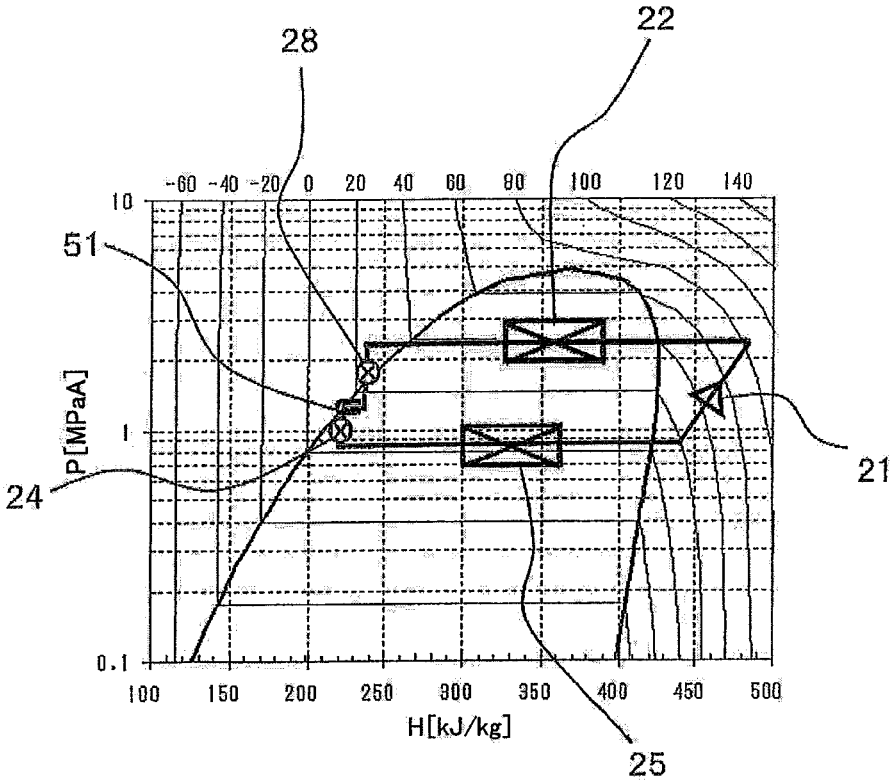
FIG. 5 is a Mollier diagram showing a normal heating operation in the air-conditioning apparatus according to Embodiment 1 of the present invention.

FIG. 5 is a Mollier diagram showing a normal heating operation of the air-conditioning apparatus according to Embodiment 1 of the present invention. Here, "normal heating operation" refers to a heating operation performed under conditions different from the low outdoor-air temperature condition. The normal heating operation will be described below with reference to FIG. 5. The description will be given with a focus on differences from the heating operation performed under the low outdoor-air temperature condition described above with reference to FIG. 4.

A process from a step of compressing a low-temperature and low-pressure gas refrigerant by the compressor 21 to a step of expanding and decompressing the gas refrigerant by the second expansion means 28 to an intermediate pressure is similar to that shown in FIG. 4. Since icicles 45 as frost do not occur in the outdoor heat exchanger 25 in the normal heating operation, the heat transfer amount in the heating unit 51 is small. Further, since the heating unit 51 is disposed at a position below the outdoor heat exchanger 25 where a little air flows, heat transfer from the heating unit 51 is restricted from being promoted by convection.

The intermediate-pressure refrigerant that has passed through the heating unit 51 is further expanded and decompressed by the first expansion means 24, and is turned into a low-temperature and low-pressure two-phase gas-liquid refrigerant (for example, saturation temperature is 2 degrees C.). This low-temperature and low-pressure two-phase gas-liquid refrigerant flows into the outdoor heat exchanger 25. The low-temperature and low-pressure two-phase gas-liquid refrigerant that has flowed in the outdoor heat exchanger 25 exchanges heat with outdoor air sent in from the outdoor fan 26, and is evaporated into a low-temperature and low-pressure gas refrigerant. The low-temperature and low-pressure gas refrigerant that has flowed out of the outdoor heat exchanger 25 is sucked into the compressor 21, where it is compressed again.

[Cooling Operation]

Figure 6:
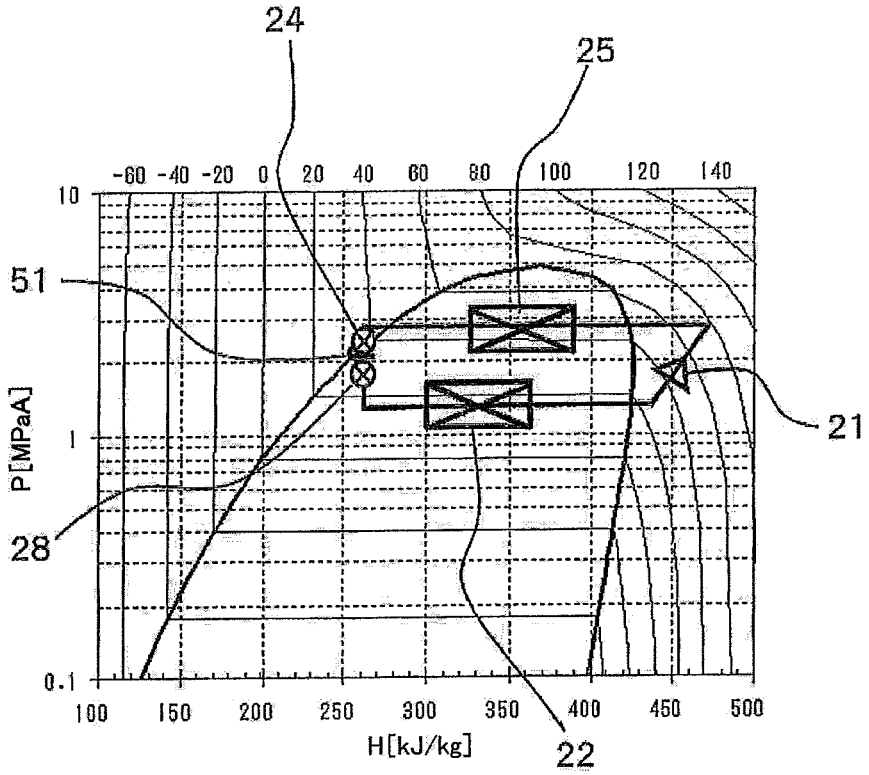
FIG. 6 is a Mollier diagram showing a cooling operation in the air-conditioning apparatus according to Embodiment 1 of the present invention.

FIG. 6 is a Mollier diagram showing a cooling operation of the air-conditioning apparatus according to Embodiment 1 of the present invention. The cooling operation will be described below with reference to FIG. 6.

First, it is assumed that, in the cooling operation, the four-way valve 27 switches the refrigerant passage such that refrigerant discharged from the compressor 21 flows toward the outdoor heat exchanger 25. A low-temperature and low-pressure gas refrigerant is compressed by the compressor 21, and is discharged in a high-temperature and high-pressure state. The high-temperature and high-pressure refrigerant discharged from the compressor 21 flows into the outdoor heat exchanger 25 via the four-way valve 27. The high-temperature and high-pressure refrigerant that has flowed in the outdoor heat exchanger 25 exchanges heat with outdoor air sent in by the outdoor fan 26, and is condensed into a high-pressure liquid refrigerant. The high-pressure liquid refrigerant that has flowed out of the outdoor heat exchanger 25 passes through the first expansion means 24. At this time, the opening degree of the first expansion means 24 is maximized to avoid expansion and decompression by the first expansion means 24. The refrigerant that has passed through the first expansion means 24 flows into the heating unit 51. According to this, the heating unit 51 does not remove heat from the outdoor heat exchanger 25, and the capacity of the indoor heat exchanger 22 is not reduced by the arrangement of the heating unit 51.

The refrigerant that has passed through the heating unit 51 is expanded and decompressed by the second expansion means 28, and is turned into a low-temperature and low-pressure two-phase gas-liquid refrigerant (for example, saturation temperature is 18 degrees C.). This low-temperature and low-pressure two-phase gas-liquid refrigerant flows into the indoor heat exchanger 22. The low-temperature and low-pressure two-phase gas-liquid refrigerant that has flowed in the indoor heat exchanger 22 exchanged heat with indoor air sent in by the indoor fan 23, and is evaporated into a low-temperature and low-pressure gas refrigerant. The low-temperature and low-pressure gas refrigerant that has flowed out of the indoor heat exchanger 22 is sucked into the compressor 21, where it is compressed again.

[Advantages of Embodiment 1]

When the heating unit 51, in which an intermediate-pressure refrigerant of 0 degrees C. or more flows, is disposed between the lowermost fin portions 44 and the drain pan 31, as in the above-described configuration, for example, heating can be efficiently performed at the positions where icicles 45 are likely to be produced by frosting during heating operation under the low outdoor-air temperature condition, for example, in the lowermost fin portions 44 of the heat transfer fins 41 in the outdoor heat exchanger 25. This can suppress the occurrences of icicles 45. Even if icicles 45 occur, they can be melted. Hence, for example, the growth of the icicles 45 can be prevented. For this reason, it is possible to restrict the heating capacity from being reduced by an increase in ventilation resistance due to the frosting phenomenon in the outdoor heat exchanger 25.

In a cooling operation, when the expansion effect of the first expansion means 24 serving as upstream expansion means, of the expansion means existing at both sides of the heating unit 51 is suppressed, the heating unit 51 does not remove heat from the outdoor heat exchanger 25, and a reduction in capacity of the indoor heat exchanger 22 can be suppressed.

In a heating operation under a condition different from the low outdoor-air temperature condition and the cooling operation, capacity equivalent to that of the conventional air-conditioning apparatus can also be maintained.

In the air-conditioning apparatus of Embodiment 1, the intermediate-pressure refrigerant is caused to constantly flow through the heating unit 51 so that the outdoor heat exchanger 25 is not frosted or so that, even when icicles 45 are formed, they are melted. Alternatively, for example, a defrosting operation may be performed separately. In this case, the heating unit 51 of Embodiment 1 may be used to assist in defrosting in a defrosting operation, or an avoiding refrigerant pipe that avoids passage of the refrigerant to the heating unit 51 may be provided, and the refrigerant may be caused to flow through the heating unit 51 only during defrosting operation. In such a case in which the defrosting operation is performed, the refrigeration cycle apparatus of Embodiment 1 can perform efficient defrosting while reducing the number of defrosting operations and the operating time.

While the heating unit 51 is formed by one turn, as illustrated in FIG. 3, the structure is not limited thereto. For example, the heating unit 51 may have a shape in accordance with the amount of frost in the lowermost fin portions 44 of the outdoor heat exchanger 25, such as a shape of one refrigerant pipe having no turn, two or more turns, or one and a half turns (S-shape). When the amount of refrigerant or the pressure loss of the refrigerant in the heating unit 51 is considered, instead of having a serial shape, such as one turn or two turns, the heating unit 51 may be divided in parallel correspondingly to a plurality of heat exchange units that constitute the outdoor heat exchanger 25. In this case, the above-described advantages can also be obtained.

While the air-conditioning apparatus of Embodiment 1 includes the four-way valve 27, and can selectively perform any of heating operation and cooling operation, as illustrated in FIG. 1, the present invention is not limited thereto. That is, the outdoor unit 12 may include no four-way valve 27, and the indoor heat exchanger 22 and the outdoor heat exchanger 25 may fixedly function as a radiator and an evaporator, respectively.

While the air-conditioning apparatus of Embodiment 1 has been described as an example of a refrigeration cycle apparatus, the present invention is not limited thereto. That is, the above-described structures and operations can also be applied not only to the air-conditioning apparatus, but also to another refrigeration cycle apparatuses such as a heat-pump water heater or a cooling device. This also applies to the following embodiments.

While the heating unit 51 is formed by a refrigerant pipe through which the intermediate-pressure refrigerant flows, the present invention is not limited thereto. The heating unit 51 may be formed by a heat generating device such as a heater, or may be formed by a combination thereof. According to this structure, similarly to the above, it is possible to melt icicles 45 occurring in the lowermost fin portions 44 of the heat transfer fins 41 in the outdoor heat exchanger 25, to suppress frosting, and to restrict the heating capacity from being reduced by an increase in ventilation resistance due to a frosting phenomenon in the outdoor heat exchanger 25. In this case, low outdoor-air temperature detection means (not illustrated) is provided to be able to detect that the low outdoor-air temperature condition is satisfied. When the low outdoor-air temperature detection means detects that the low outdoor-air temperature condition is satisfied, the heat generating device, such as a heater, is driven.

Embodiment 2

An air-conditioning apparatus according to Embodiment 2 will be described with a focus on differences from the air-conditioning apparatus according to Embodiment 1.

[Structure of Outdoor Unit 12]

Figure 7:
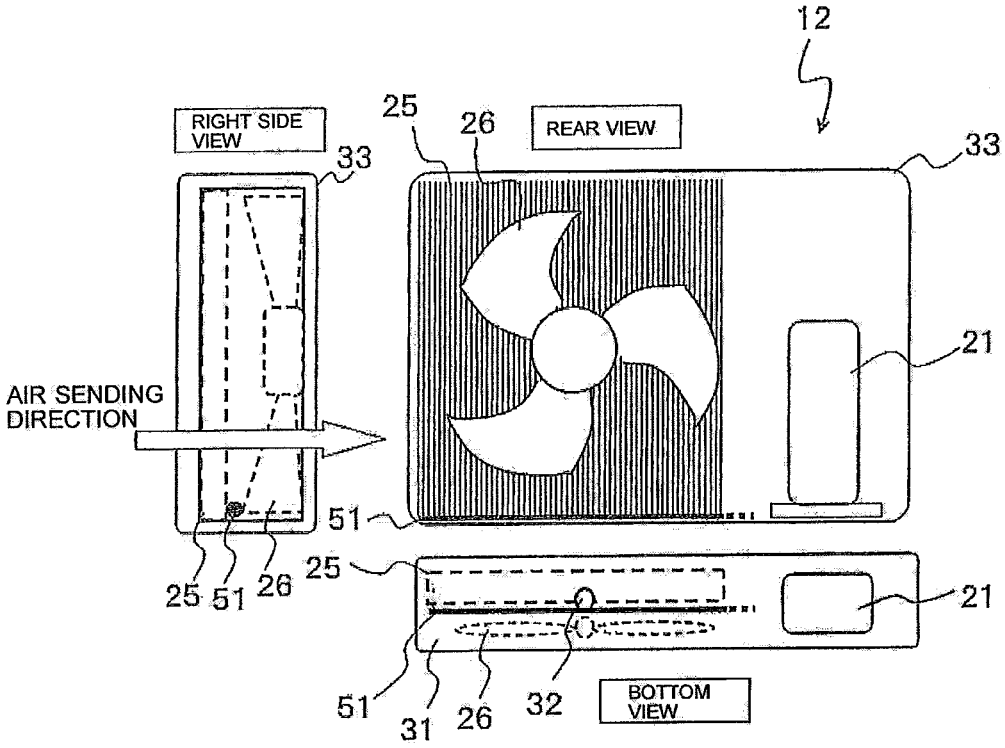
FIG. 7 schematically illustrates a structure of an outdoor unit 12 in an air-conditioning apparatus according to Embodiment 2 of the present invention.

FIG. 7 schematically illustrates a structure of an outdoor unit 12 in an air-conditioning apparatus according to Embodiment 2 of the present invention. FIG. 7 illustrates a rear view, a bottom view, and a right side view of the outdoor unit 12. In FIG. 7, the shape, arrangement, etc. of a heating unit 51 will be mainly described, and illustrations of other elements that constitute a refrigeration cycle, such as refrigerant pipes and devices, are partly omitted. The elements whose illustrations are omitted are basically similar to those of the outdoor unit 12 according to Embodiment 1 illustrated in FIG. 3.

An outdoor heat exchanger 25 is different from the outdoor heat exchanger 25 in the outdoor unit 12 of Embodiment 1, and is formed by one heat exchange unit subjected to water slip or water repellant treatment.

An outdoor fan 26 is rotationally driven to send air in a direction from the outdoor heat exchanger 25 toward the outdoor fan 26.

The heating unit 51 is disposed between the outdoor heat exchanger 25 and the outdoor fan 26 and near lowermost fin portions 44 of the outdoor heat exchanger 25. That is, the heating unit 51 is disposed on a leeward side of the lowermost fin portions 44 of the outdoor heat exchanger 25. The heating unit 51 is disposed near and on the leeward side of the lowermost fin portions 44 to suppress a decrease in heat exchange capacity of the outdoor heat exchanger 25.

To reduce the ventilation resistance of the outdoor heat exchanger 25, it is better that the number of turns of the heating unit 51 is small. Therefore, the heating unit 51 is preferably formed by one turn or a single refrigerant pipe having no turn.

[Frosting Phenomenon in Outdoor Heat Exchanger 25]

Next, a frosting phenomenon occurring in the outdoor heat exchanger 25 during heating operation will be described with reference to FIG. 2.

As described above, icicles 45 as frost are formed by fallen condensed water droplets 43 in the outdoor heat exchanger 25 subjected to water slip or water repellant treatment. At this time, according to the action of the water slip or water repellent treatment of the outdoor heat exchanger 25, a phenomenon in which the condensed water droplets 43 move leeward while dropping under their own weight is sometimes increased by a suction effect of the outdoor fan 26. In this case, the icicles 45 are concentrically formed on the leeward side of the lowermost fin portions 44 of the heat transfer fins 41. When the condensed water droplets 43 freeze while forming bridges between the heat transfer fins 41, the ventilation resistance of the outdoor heat exchanger 25 increases, and this leads to a decrease in capacity. When a defrosting operation is performed at that time, the frozen condensed water droplets 43 slide down before being completely melted in the outdoor heat exchanger 25 subjected to water slip or water repellant treatment. The slid condensed water droplets 43, which are not completely melted, remain on the leeward side of the lowermost fin portions 44 because of the suction effect of the outdoor fan 26, and icicles 45 concentrically grow. As described above, the icicles 45, which are concentrically formed and grown on the leeward side of the lowermost fin portions 44 of the heat transfer fins 41, sometime grow near the outdoor fan 26. This has an influence on rotational driving of the outdoor fan 26.

However, since the heating unit 51 is disposed between the outdoor heat exchanger 25 and the outdoor fan 26 and near the lowermost fin portions 44 in the outdoor heat exchanger 25, as described above, for example, formation of icicles 45 can be suppressed.

[Advantages of Embodiment 2]

As in the above-described structure, the outdoor heat exchanger 25 is formed by a single heat exchange unit subjected to water slip or water repellant treatment, and the heating unit 51 is disposed between the outdoor heat exchanger 25 and the outdoor fan 26 and near the lowermost fin portions 44 of the outdoor heat exchanger 25, so that the icicles 45 concentrically formed on the leeward side of the lowermost fin portions 44 can be melted and frosting in the lowermost fin portions 44 can be suppressed. This can restrict the heating capacity from being reduced by an increase in ventilation resistance due to the frosting phenomenon in the outdoor heat exchanger 25.

Further, when the heating unit 51 is set between the outdoor heat exchanger 25 and the outdoor fan 26 and near the lowermost fin portions 44 in the outdoor heat exchanger 25, and is disposed on the leeward side of the outdoor heat exchanger 25, formation of icicles 45 can be suppressed. Further, even when icicles 45 are formed, they are melted by the heating unit, and do not grow to reach the outdoor fan 26. Hence, the outdoor fan 26 can be safely driven without interfering with the rotation thereof.

Embodiment 3

An air-conditioning apparatus according to Embodiment 3 will be described with a focus on differences from the air-conditioning apparatus according to Embodiment 1.

[Structure of Outdoor Unit 12]

Figure 8:
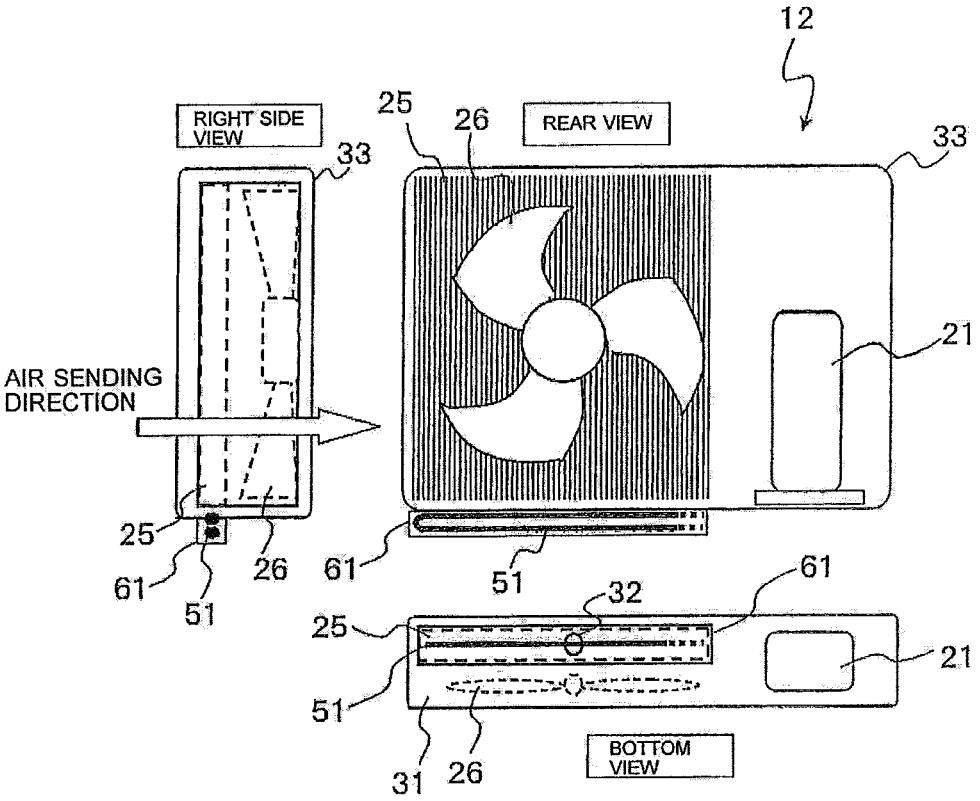
FIG. 8 schematically illustrates a structure of an outdoor unit 12 in an air-conditioning apparatus according to Embodiment 3 of the present invention.

FIG. 8 schematically illustrates a structure of an outdoor unit 12 in an air-conditioning apparatus according to Embodiment 3 of the present invention. FIG. 8 illustrates a rear view, a bottom view, and a right side view of the outdoor unit 12. In FIG. 8, the shape, arrangement, etc. of a heating unit 51 will be mainly described, and illustrations of other elements that constitute a refrigeration cycle, such as refrigerant pipes and devices, are partly omitted. The elements whose illustrations are omitted are basically similar to those of the outdoor unit 12 according to Embodiment 1 illustrated in FIG. 3.

As illustrated in FIG. 8, in the outdoor unit 12 in the air-conditioning apparatus of Embodiment 3, a groove 61 is provided in a portion of a drain pan 31 positioned just below an outdoor heat exchanger 25. A drain hole 32 is provided at least one position to penetrate the groove 61 and a bottom surface of a unit case 33. Drain water retained in the groove 61 is drained outside through the drain hole 32.

The drain hole 32 may be provided not only in the groove 61 of the drain pan 31, but also in other portions on the drain pan 31.

An outdoor fan 26 is rotationally driven to send air in a direction from the outdoor heat exchanger 25 toward the outdoor fan 26.

A direction in which air is sent by rotational driving of the outdoor fan 26 is not limited to the direction from the outdoor heat exchanger 25 toward the outdoor fan 26, as illustrated in FIG. 8, and may be a direction from the outdoor fan 26 toward the outdoor heat exchanger 25.

The heating unit 51 is set in the above-described groove 61, and is received out of contact with an inner surface of the groove 61. Thus, it is prevented that the interference of air sending of the outdoor fan 26 by the presence of the heating unit 51, and this can suppress a decrease in ventilation resistance of the outdoor heat exchanger 25.

The heating unit 51 does not always need to be entirely received in the groove 61. For example, one refrigerant pipe or one turn that forms the heating unit 51 may protrude upward from an aperture of the groove 61.

The width of the groove 61 is equivalent to or slightly more than the width of the outdoor heat exchanger 25. Further, the longitudinal length of the groove 61 is equivalent to the longitudinal length of the outdoor heat exchanger 25.

[Frosting Phenomenon in Outdoor Heat Exchanger 25]

Next, a frosting phenomenon occurring in the outdoor heat exchanger 25 and the drain pan 31 during heating operation will be described with reference to FIG. 2 and FIG. 8 illustrating Embodiment 3.

As described above, icicles 45 as frost are formed in lowermost fin portions 44 by fallen condensed water droplets 43 in the outdoor heat exchanger 25 subjected to water slip or water repellant treatment. At this time, supercooled condensed water droplets 43, which have fallen on heat transfer fins 41, are released from a supercooled state when they contact the icicles 45. In contrast, condensed water droplets 43, which have fallen from the lowermost fin portions 44 without being influenced by the icicles 45, are released from a supercooled state and frozen on the drain pan 31. When the condensed water droplets 43 frozen on the drain pan 31 grow to reach the outdoor heat exchanger 25, they form an ice block on the drain pan 31. This increases the ventilation resistance of the outdoor heat exchanger 25.

However, the outdoor unit 12 of Embodiment 3 adopts the structure in which the groove 61 is formed in the above-described manner and the heating unit 51 is received in the groove 61. Hence, even when icicles 45 are formed in the lowermost fin portions 44, as described above, they are melted by the heating unit 51, and are retained as drain water in the groove 61. When not less than a predetermined amount of drain water is retained in the groove 61, it does not freeze in the groove 61, but is kept in a state of 0 degrees C. or more because the intermediate-pressure refrigerant of 0 degrees C. or more flows in the heating unit 51. This allows the drain water to be stably disposed of. Further, even when the condensed water droplets 43 fall in the groove 61, they do not freeze. This can suppress formation of an ice block on the drain pan 31. Also, the ventilation resistance of the outdoor heat exchanger 25 can be restricted from being increased by the ice block.

[Advantages of Embodiment 3]

By forming the groove 61 just below the outdoor heat exchanger 25 and receiving the heating unit 51 in the groove 61 as in the above-described structure, icicles 45 formed in the lowermost fin portions 44 can, of course, be melted into drain water, and the drain water can be kept at 0 degrees C. or more and can be stably disposed of.

Even when the condensed water droplets 43 released from the supercooled state fall from the lowermost fin portions 44 onto the drain pan 31, they fall in the groove 61 that retains the drain water of 0 degrees C. or more. Hence, the condensed water droplets 43 do not freeze, and this can suppress formation of an ice block on the drain pan 31. Also, the ventilation resistance of the outdoor heat exchanger 25 can be restricted from being increased by the ice block.

Embodiment 4

An air-conditioning apparatus according to Embodiment 4 will be described with a focus on differences from the air-conditioning apparatus according to Embodiment 1.

[Structure of Outdoor Unit 12]

Figure 9:
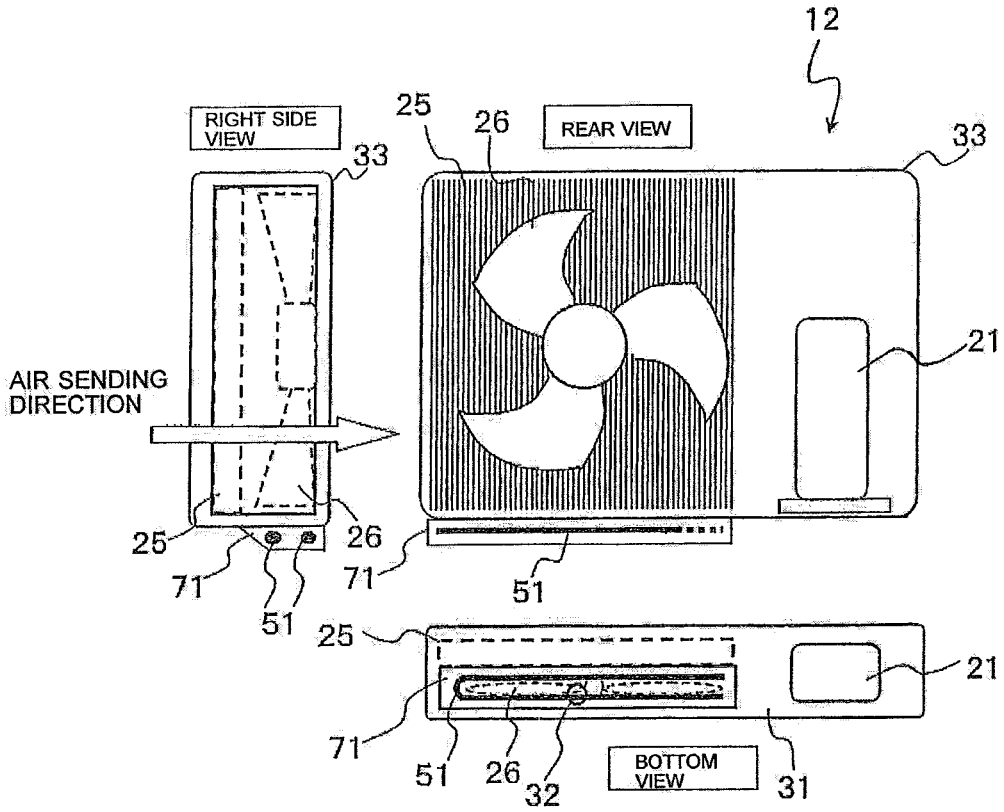
FIG. 9 schematically illustrates a structure of an outdoor unit 12 in an air-conditioning apparatus according to Embodiment 4 of the present invention.

FIG. 9 schematically illustrates a structure of an outdoor unit 12 in an air-conditioning apparatus according to Embodiment 4 of the present invention. FIG. 9 illustrates a rear view, a bottom view, and a right side view of the outdoor unit 12. In FIG. 9, the shape, arrangement, etc. of a heating unit 51 will be mainly described, and illustrations of other elements that constitute a refrigeration cycle, such as refrigerant pipes and devices, are partly omitted. The elements whose illustrations are omitted are basically similar to those of the outdoor unit 12 according to Embodiment 1 illustrated in FIG. 3.

As illustrated in FIG. 9, in the outdoor unit 12 in the air-conditioning apparatus of Embodiment 4, a stepped portion 71 is provided in a part of a drain pan 31 extending from a leeward portion of an outdoor heat exchanger 25 subjected to water slip or water repellant treatment to a portion just below an outdoor fan 26. A drain hole 32 is provided in at least one position to penetrate the stepped portion 71 and a bottom surface of a unit case 33. Drain water retained in the stepped portion 71 is drained outside through the drain hole 32.

The drain hole 32 may be provided not only in the stepped portion 71 of the drain pan 31, but also in other portions on the drain pan 31.

The outdoor fan 26 is rotationally driven to send air in a direction from the outdoor heat exchanger 25 toward the outdoor fan 26.

The heating unit 51 is set in the above-described stepped portion 71, and is received out of contact with an inner surface of the stepped portion 71. A received refrigerant pipe is formed by a single pipe, or a pipe having one or more turns. Thus, it is prevented that the interference of air sending of the outdoor fan 26 by the presence of the heating unit 51, and this can suppress an increase in ventilation resistance of the outdoor heat exchanger 25. In a case in which a refrigerant pipe having one or more turns is received as the heating unit 51 in the stepped portion 71, when sections of the refrigerant pipe that form the turns are arranged in a direction parallel to the air sending direction of the outdoor fan 26, the entire heating unit 51 is easily received in the stepped portion 71, and an effect of the outdoor heat exchanger 25 of reducing the ventilation resistance can be increased further. While the heating unit 51 is set below the outdoor heat exchanger 25 in Embodiment 1 or Embodiment 3, the heating unit 51 is set below the outdoor fan 26 in Embodiment 4.

The heating unit 51 does not always need to be entirely received in the stepped portion 71. For example, one refrigerant pipe or one turn that forms the heating unit 51 may protrude upward from an aperture of the stepped portion 71.

The longitudinal length of the stepped portion 71 is set to be equivalent to the longitudinal length of the outdoor heat exchanger 25. Also, to guide drain water, which is formed from fallen condensed water droplets 43, into the stepped portion 71, the stepped portion 71 is shaped such that its depth continuously increases from the leeward side portion of the outdoor heat exchanger 25 toward the outdoor fan 26, that is, the stepped portion 71 has a slope shape, as illustrated in FIG. 9.

[Advantages of Embodiment 4]

By forming the stepped portion 71 having a slope shape from the leeward portion of the outdoor heat exchanger 25 toward the portion just below the outdoor fan 26 and receiving the heating unit 51 in the stepped portion 71 as in the above-described structure, icicles 45 described in Embodiment 2, which grow near the outdoor fan 26 on the leeward side of the lowermost fin portions 44, can be melted, and the growth of the icicles 45 can be suppressed. Further, since the stepped portion 71 has a slope shape, drain water, which is formed from condensed water droplets 43 fallen from the lowermost fin portions 44 of the outdoor heat exchanger 25, can be guided into the stepped portion 71. This allows the drain water to be disposed of stably.

By receiving the heating unit 51 in the stepped portion 71, the ventilation resistance of the outdoor heat exchanger 25 due to rotational driving of the outdoor fan 26 can be reduced.

Further, by storing a predetermined amount of drain water of 0 degrees C. or more in the stepped portion 71, supercooled condensed water droplets 43 fallen from the lowermost fin portions 44, which are described in Embodiment 3, can be guided into the stepped portion 71 by the slope of the stepped portion 71. This can prevent the condensed water droplets 43 from freezing after falling.

Embodiment 5

An air-conditioning apparatus according to Embodiment 5 will be described with a focus on differences from the air-conditioning apparatus according to Embodiment 1.

[Structure of Outdoor Heat Exchanger 25]

Figure 10:
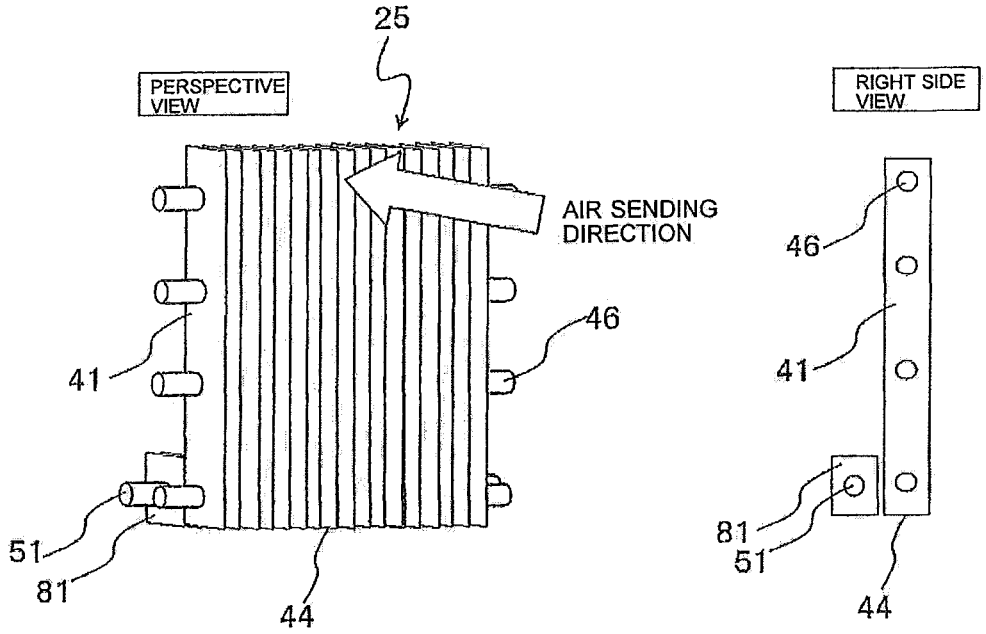
FIG. 10 illustrates a structure of an outdoor heat exchanger 25 in an air-conditioning apparatus according to Embodiment 5 of the present invention.

FIG. 10 illustrates a structure of an outdoor heat exchanger 25 in an air-conditioning apparatus according to Embodiment 5 of the present invention.

As illustrated in FIG. 10, the outdoor heat exchanger 25 of Embodiment 5 is different from the outdoor heat exchanger 25 of Embodiment 1 in being formed by one heat exchange unit subjected to water slip or water repellant treatment. An outdoor fan 26 (not illustrated) is arranged similarly to that adopted in the outdoor unit 12 of Embodiment 1, and is rotationally driven to send air in a direction from the outdoor heat exchanger 25 toward the outdoor fan 26. In the outdoor heat exchanger 25, a melting unit 81 including a heating unit 51 is set between the outdoor heat exchanger 25 and the outdoor fan 26 and near lowermost fin portions 44 of the outdoor heat exchanger 25, in addition to heat transfer fins 41 and heat transfer tubes 46 that constitute the heat exchange unit. That is, the melting unit 81 is disposed on a leeward side of the outdoor heat exchanger 25. The melting unit 81 is disposed near and on the leeward side of the lowermost fin portions 44 to suppress reduction in heat exchange capacity of the outdoor heat exchanger 25. Further, the melting unit 81 is formed by attaching, to the heating unit 51 serving as a refrigerant pipe, a plurality of fin portions arranged in parallel in the longitudinal direction of the heating unit 51, similarly to the outdoor heat exchanger 25.

[Advantages of Embodiment 5]

When the melting unit 81, in which a plurality of fin portions are attached to the heating unit 51 serving as the refrigerant pipe, is disposed between the outdoor heat exchanger 25 and the outdoor fan 26 and near the lowermost fin portions 44 of the outdoor heat exchanger 25 (disposed on the leeward side of the outdoor heat exchanger 25) as in the above-described structure, it is possible to increase the effect of suppressing formation of icicles 45 as frost in the lowermost fin portions 44 of the outdoor heat exchanger 25 or melting formed icicles 45 and an effect of suppressing frosting in the lowermost fin portions 44.

When the melting unit 81 is set between the outdoor heat exchanger 25 and the outdoor fan 26 and near the lowermost fin portions 44 in the outdoor heat exchanger 25 and is disposed on the leeward side of the outdoor heat exchanger 25, formation of icicles 45 can be suppressed. Even when icicles 45 are formed, they are melted by the heating unit, and do not grow to the outdoor fan 26. Hence, the outdoor fan 26 can be safely driven without hindering the rotation thereof.

Figure 11:
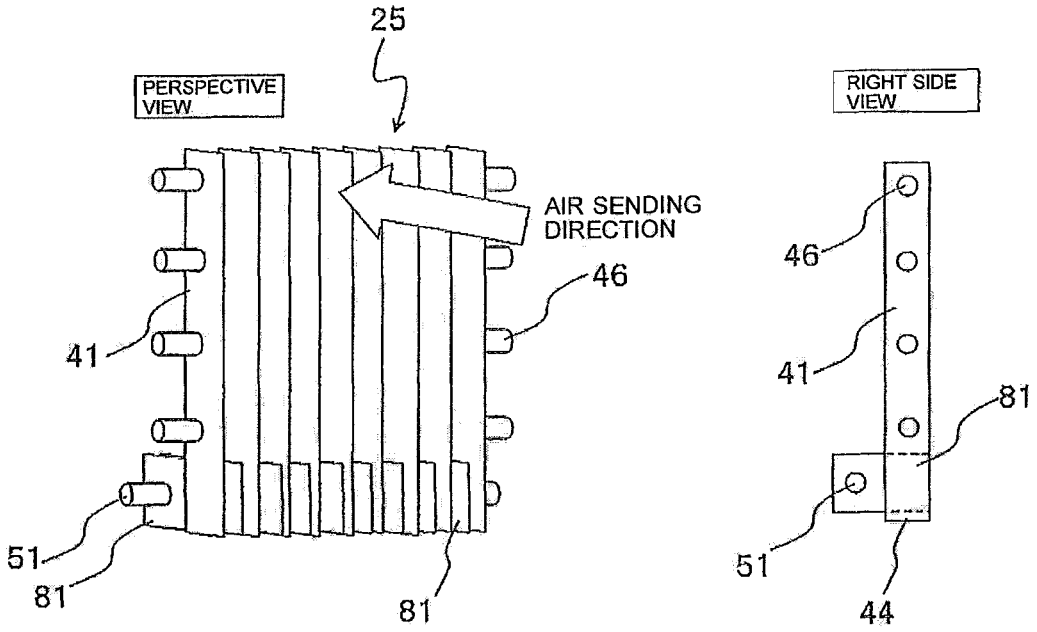
FIG. 11 illustrates a structure of another example of an outdoor heat exchanger 25 in the air-conditioning apparatus according to Embodiment 5 of the present invention.
Figure 12:
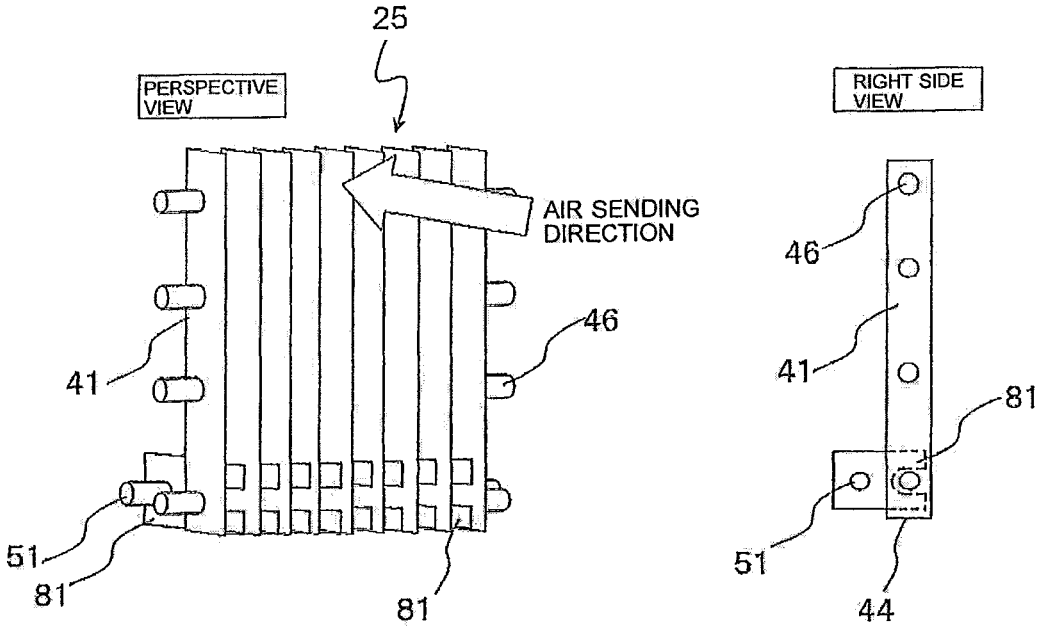
FIG. 12 illustrates a structure of yet another example of an outdoor heat exchanger 25 in the air-conditioning apparatus according to Embodiment 5 of the present invention.

As illustrated in FIG. 11, the fin portions set on the heating unit 51 of the melting unit 81 may be inserted between the heat transfer fins 41 of the outdoor heat exchanger 25. Alternatively, as illustrated in FIG. 12, the fin portions set to the heating unit 51 of the melting unit 81 may have cutouts, and the melting unit 81 may be set such that the lowermost heat transfer tube 46 is located in these cutouts. This can further increase the effect of melting frost occurring in the lowermost fin portions 44 of the outdoor heat exchanger 25.

Embodiment 6

An air-conditioning apparatus according to Embodiment 6 will be described with a focus on differences from the air-conditioning apparatus according to Embodiment 1.

[Configuration of Air-Conditioning Apparatus]

Figure 13:
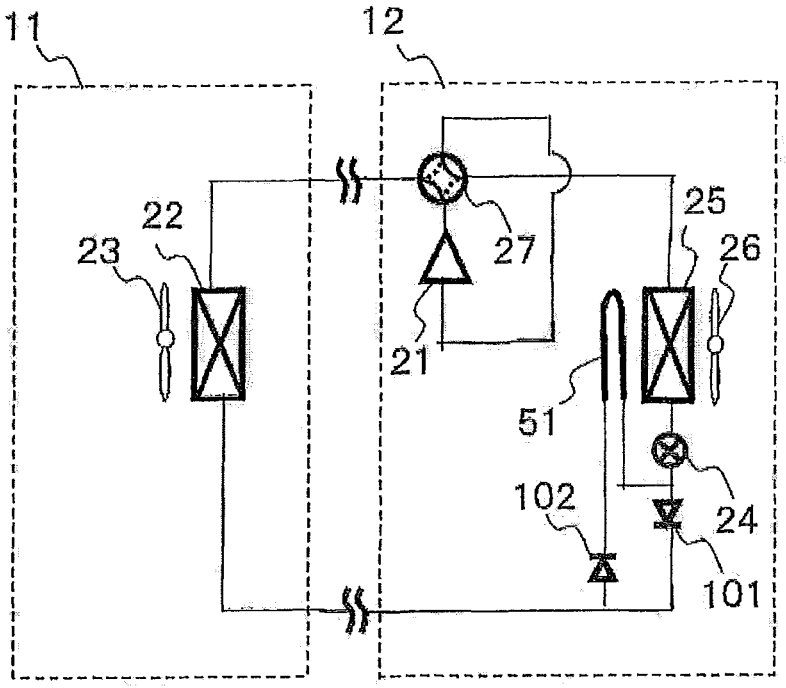
FIG. 13 illustrates a configuration of a refrigerant circuit in an air-conditioning apparatus according to Embodiment 6 of the present invention.

FIG. 13 illustrates a configuration of a refrigerant circuit in an air-conditioning apparatus according to Embodiment 6 of the present invention.

While the refrigerant pipe between the first expansion means 24 and the second expansion means 28 is utilized as the heating unit 51 in the air-conditioning apparatus of Embodiment 1, a heating unit 51 is structured using a first check valve 101 and a second check valve 102 in Embodiment 6. Specifically, the air-conditioning apparatus of Embodiment 6 does not include second expansion means 28, and an indoor heat exchanger 22 and first expansion means 24 are connected to each other. Further, in an outdoor unit 12, a first check valve 101 is set to a refrigerant pipe that connects the first expansion means 24 and the indoor heat exchanger 22. A refrigerant pipe branching off from a refrigerant pipe for connecting the first check valve 101 and the indoor heat exchanger 22 is connected, via a second check valve 102, to a refrigerant pipe that forms the heating unit 51. The other end of the heating unit 51 is connected to a refrigerant pipe for connecting the first expansion means 24 and the first check valve 101.

The first check valve 101 allows the refrigerant to flow only in a direction from the first expansion means 24 toward the indoor heat exchanger 22, and the second check valve 102 allows the refrigerant to flow only in a direction from the above-described branch point toward the heating unit 51.

[Advantages of Embodiment 6]

In the above-described configuration illustrated in FIG. 13, when a heating operation is being performed under a low outdoor-air temperature condition, a high-pressure refrigerant flowing out from the indoor heat exchanger 22 flows through the heating unit 51 via the first check valve 101. Hence, frost occurring in the outdoor heat exchanger 25 can be melted, and frosting in the outdoor heat exchanger 25 can be suppressed.

Figure 14:
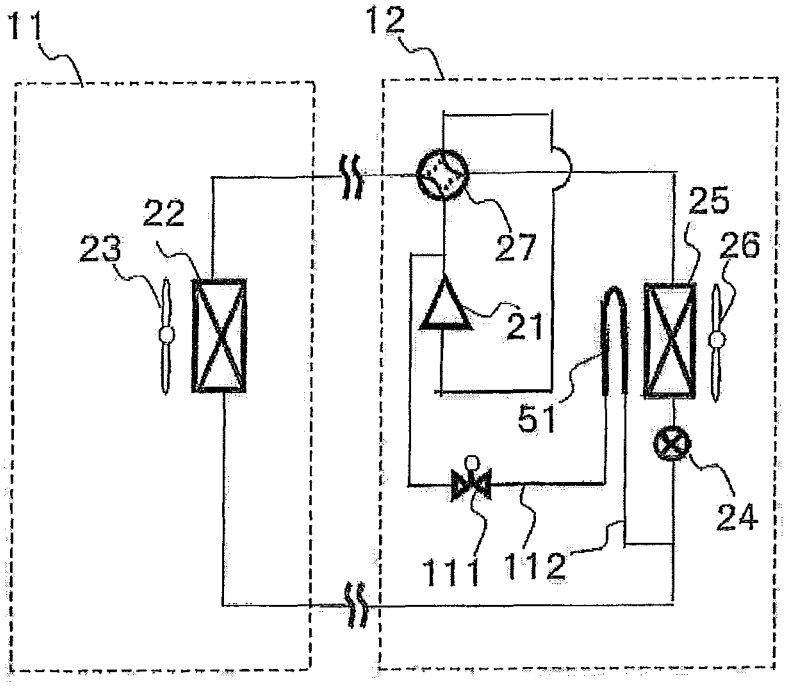
FIG. 14 illustrates a configuration of another example of a refrigerant circuit in the air-conditioning apparatus according to Embodiment 6 of the present invention.

FIG. 14 illustrates a configuration of another example of a refrigerant circuit in the air-conditioning apparatus according to Embodiment 6, in which a heating unit 51 is structured using an on-off valve 111 and a hot gas bypass pipe 112. Specifically, the second expansion means 28 adopted in the air-conditioning apparatus of Embodiment 1 is not provided, and an indoor heat exchanger 22 and first expansion means 24 are connected to each other. In an outdoor unit 12, the heating unit 51 is formed by a part of a hot gas bypass pipe 112 that branches off from a refrigerant pipe on a discharge side of a compressor 21 and is connected to a refrigerant pipe for connecting the indoor heat exchanger 22 and the first expansion means 24. Further, an on-off valve 111 is set to the hot gas bypass pipe 112. In the configuration illustrated in FIG. 14, when the heating operation is being performed under a low outdoor-air temperature condition, gas refrigerant (hot gas) discharged from the compressor 21 can flow to the heating unit 51 via the on-off valve 111. Hence, frost occurring in the outdoor heat exchanger 25 can be melted. When a melting operation of the heating unit 51 is unnecessary, for example, during heating operation under a condition different from the low outdoor-air temperature condition and the cooling operation, the on-off valve 111 is closed.

The configuration of the air-conditioning apparatus of Embodiment 6 illustrated in FIG. 13 or 14 can be applied to Embodiments 1 to 5.

While the arrangement of the heating unit 51 has been described in conjunction with Embodiments 1 to 5, the position of the heating unit 51 is not limited to the positions adopted in Embodiments 1 to 5. That is, the heating unit 51 may be positioned in a combination of the manners adopted in Embodiment 1 or Embodiment 3, and Embodiment 2 or Embodiment 5. Alternatively, the heating unit 51 may be positioned in a combination of the above combination or the manner of any of the embodiments, and the manner adopted in Embodiment 4.

In a typical air-conditioning apparatus, R410A is used as refrigerant. In contrast, since heating is performed using hot gas of refrigerant in the configuration illustrated in FIG. 14, a refrigerant having a gas specific heat ratio higher than that of R410A, such as R32, is effective in obtaining the advantages of the present invention. A refrigerant in which HFO1234yf is mixed in R32 is also effective in obtaining the advantages of the present invention because it has a specific heat ratio higher than that of R410A.

REFERENCE SIGNS LIST

11: indoor unit, 12: outdoor unit, 21: compressor, 22: indoor heat exchanger, 23: indoor fan, 24: first expansion means, 25: outdoor heat exchanger, 26: outdoor fan, 27: four-way valve, 28: second expansion means, 31: drain pan, 32: drain hole, 33: unit case, 41: heat transfer fin, 42: windward portion, 43: condensed water droplet, 44: lowermost fin portion, 45: icicle, 46: heat transfer tube, 51: heating unit, 61: groove, 71: stepped portion, 81: melting unit, 101: first check valve, 102: second check valve, 111: on-off valve, 112: hot gas bypass pipe.

The invention claimed is:

1. A refrigeration cycle apparatus including a compressor, a condenser, an expansion device, and an evaporator having a heat exchanger that includes a plurality of plate-like heat transfer fins arranged in parallel, and a heat transfer tube provided in contact with the plurality of heat transfer fins, the compressor, the condenser, the expansion device, and the evaporator being connected by refrigerant pipes to form a refrigeration cycle, the refrigeration cycle apparatus comprising:

an evaporator fan for producing an air current flowing to the evaporator, the evaporator fan being disposed to send the air current in a direction from the evaporator toward the evaporator fan; and a heating unit disposed on a lower and leeward side of the heat transfer fins of the evaporator, wherein the plurality of heat transfer fins of the evaporator are subjected to water slip or water repellent treatment, at least a part of the heating unit is formed by one refrigerant pipe of the refrigerant pipes, a plurality of fin portions are provided on a part of the one refrigerant pipe forming the heating unit, the plurality of fin portions of the heating unit being disposed along a direction in which the heat transfer fins are arranged in parallel, and the plurality of fin portions provided on the part of the one refrigerant pipe forming the heating unit are inserted between lower and leeward side portions of the heat transfer fins of the evaporator.

2. The refrigeration cycle apparatus of claim 1, wherein the heating unit is disposed out of contact with the evaporator.

3. The refrigeration cycle apparatus of claim 2, wherein the heating unit is disposed along a direction in which the heat transfer fins are arranged in parallel.

4. The refrigeration cycle apparatus of claim 1, wherein the heating unit is disposed along a direction in which the heat transfer fins are arranged in parallel.

5. The refrigeration cycle apparatus of claim 1, further comprising:

a first check valve provided in another refrigerant pipe of the refrigerant pipes between the expansion device and the condenser to allow the refrigerant to flow only in a direction from the expansion device toward the condenser; and a second check valve provided in the one refrigerant pipe forming part of the heating unit, the one refrigerant pipe branching off from the another refrigerant pipe, wherein the one refrigerant pipe forming part of the heating eludes another part containing the second check valve that is connected to the another refrigerant pipe, and wherein the second check valve allows the refrigerant to flow in the one refrigerant pipe only in a direction from the another refrigerant pipe toward the heating unit.

6. The refrigeration cycle apparatus of claim 1, wherein the one refrigerant pipe forming part of the heating unit is a part of a hot gas bypass pipe, the hot gas bypass pipe branching off from another refrigerant pipe of the refrigerant pipes between the expansion device and the condenser, and connecting to a discharge side of the compressor, and wherein an on-off mechanism is provided in the hot gas bypass pipe.

7. The refrigeration cycle apparatus of claim 6, wherein the refrigerant is R32.

8. The refrigeration cycle apparatus of claim 6, wherein the refrigerant is a mixed refrigerant of R32 and HFO1234yf.

9. A refrigeration cycle apparatus including a compressor, a condenser, a first expansion device, and an evaporator having a heat exchanger that includes a plurality of plate-like heat transfer fins arranged in parallel, and a heat transfer tube provided in contact with the plurality of heat transfer fins, the compressor, the condenser, the first expansion device, and the evaporator being connected by refrigerant pipes to form a refrigeration cycle, the refrigeration cycle apparatus comprising:

an evaporator fan for producing an air current flowing to the evaporator, the evaporator fan being disposed to send the air current in a direction from the evaporator toward the evaporator fan;

a heating unit disposed on a lower and leeward side of the heat transfer fins of the evaporator; and a second expansion device provided in one refrigerant pipe between the first expansion device and the evaporator, wherein at least a part of the heating unit is formed by a part of the one refrigerant pipe between the first expansion device and the second expansion device, the plurality of heat transfer fins of the evaporator are subjected to water slip or water repellent treatment, a plurality of fin portions are provided on the part of the one refrigerant pipe forming the heating unit, the plurality of fin portions of the heating unit being disposed along a direction in which the heat transfer fins are arranged in parallel, and the plurality of fin portions provided on the part of the one refrigerant pipe forming the heating unit are inserted between lower and leeward side portions of the heat transfer fins of the evaporator.

* * * * *